US009340218B2

(12) United States Patent
Ogawa

(10) Patent No.: US 9,340,218 B2
(45) Date of Patent: May 17, 2016

(54) RAILWAY VEHICLE DAMPING DEVICE

(71) Applicant: KAYABA INDUSTRY CO., LTD., Tokyo (JP)

(72) Inventor: Takayuki Ogawa, Sagamihara (JP)

(73) Assignee: KYB Corporation, Tokyo (JP)

( * ) Notice: Subject to any disclaimer, the term of this patent is extended or adjusted under 35 U.S.C. 154(b) by 84 days.

(21) Appl. No.: 14/346,322

(22) PCT Filed: Mar. 13, 2013

(86) PCT No.: PCT/JP2013/056944

§ 371 (c)(1),
(2) Date: Mar. 20, 2014

(87) PCT Pub. No.: WO2013/137294

PCT Pub. Date: Sep. 19, 2013

(65) Prior Publication Data

US 2014/0318411 A1 Oct. 30, 2014

(30) Foreign Application Priority Data

Mar. 14, 2012 (JP) ..... 2012-056847

(51) Int. Cl.
*B61F 5/22* (2006.01)
*B61F 5/24* (2006.01)

(52) U.S. Cl.
CPC ..... *B61F 5/245* (2013.01)

(58) Field of Classification Search
CPC ..... B61F 5/00; B61F 5/02; B61F 5/14; B61F 5/144; B61F 5/22; B61F 5/24; B61F 5/38; B61F 5/386; B61F 5/40
USPC ..... 105/199.1–199.4, 209
See application file for complete search history.

(56) References Cited

U.S. PATENT DOCUMENTS 5,558,024 A * 9/1996 Solera et al. ..... 105/199.2
6,397,129 B1 * 5/2002 Lanoix et al. ..... 701/19
2011/0192157 A1 8/2011 Ogawa

FOREIGN PATENT DOCUMENTS

JP 2003-320931 A 11/2003
JP 2008-247204 A 10/2008
JP 2008-247333 A 10/2008
JP 2011-184017 A 9/2011
JP 2011-184018 A 9/2011
JP 2011-184019 A 9/2011
JP 2011-201333 A 10/2011
WO WO 2010-030025 A1 3/2010

OTHER PUBLICATIONS

Extended European Search Report dated May 27, 2015.

* cited by examiner

*Primary Examiner* — R. J. McCarry, Jr.
(74) *Attorney, Agent, or Firm* — Rabin & Berdo, P.C.

(57) ABSTRACT

A railway vehicle damping device comprises at least two front side actuators interposed between a front bogie and a vehicle body of a railway vehicle, and at least two rear side actuators interposed between a rear bogie and the vehicle body of the railway vehicle, and suppresses vibration in a yaw direction of the vehicle body using a yaw suppression force generated by the actuators. After determining that the railway vehicle is traveling in a curve section, a control device causes at least one of the front side actuators and at least one of the rear side actuators to generate a yaw suppression force, and causes all of the remaining actuators to function as passive dampers. As a result, passenger comfort in the railway vehicle during travel in the curve section is improved.

9 Claims, 4 Drawing Sheets

RAILWAY VEHICLE DAMPING DEVICE

TECHNICAL FIELD

This invention relates to suppression of vibration in a railway vehicle during travel on a curve.

BACKGROUND ART

A railway vehicle damping device that suppresses vibration of a railway vehicle body in a right-left direction relative to a running direction of the railway vehicle comprises, for example, a variable damping force damper interposed between the vehicle body and a bogie. A damping force required to suppress the vibration of the vehicle body is determined from a yaw direction angular velocity of the vehicle body and a sway direction velocity of the vehicle body in a vehicle body center, and a damping force of the variable damping force damper is adjusted so that the determined damping force can be generated.

More specifically, a damping force required to suppress yaw direction vibration is calculated by multiplying a distance from a vehicle center to a bogie center and a control gain by a yaw rate. Further, a damping force required to suppress sway direction vibration is calculated by multiplying a control gain by the sway direction velocity. The damping force to be generated by the variable damping force damper is then calculated as a sum of the yaw direction vibration suppressing damping force and the sway direction vibration suppressing damping force.

JP2003-320931A, published by the Japan Patent Office, proposes providing variable damping force dampers for suppressing yaw direction and sway direction vibration respectively between a vehicle body of a railway vehicle and a bogie that supports a vehicle body front portion and between the vehicle body and a bogie that supports a vehicle body rear portion.

SUMMARY OF INVENTION

A resonance frequency band of a vehicle body of a railway vehicle is from 0.5 hertz (Hz) to 2 Hz. When the railway vehicle travels through a curve section, centrifugal acceleration acts on the vehicle body. Herein, a frequency of the centrifugal acceleration is extremely close to the resonance frequency of the vehicle body.

To obtain the yaw rate and the sway direction velocity of the vehicle body, acceleration sensors provided at a front and a rear of the vehicle body are typically used. The yaw rate is determined on the basis of an acceleration difference obtained by the acceleration sensors. The sway direction velocity is determined on the basis of a value obtained as a sum of the two accelerations obtained by the acceleration sensors.

With regard to the yaw rate, since the acceleration difference is obtained, the effect of the centrifugal acceleration acting on the vehicle body when the railway vehicle travels through a curve section can be eliminated. The sway direction velocity, on the other hand, is determined on the basis of a sum of the accelerations, and therefore the centrifugal acceleration is superimposed on the acceleration of the vibration. The effect of the centrifugal acceleration is not eliminated in the calculation of the sway direction velocity. When the railway vehicle increases in speed, the effect of the centrifugal acceleration is considerable, and therefore, when the damping force is determined in a state where the effect of the centrifugal acceleration remains superimposed on the sway direction velocity calculation, the damping force becomes excessively large, leading to a reduction in passenger comfort in the railway vehicle.

An attempt may be made to extract only vibration at the resonance frequency of the vehicle body by filtering the sway direction railway vehicle velocity using a band pass filter or a high pass filter. It is however difficult to remove the centrifugal acceleration since, as described above, the frequency of the centrifugal acceleration and the resonance frequency are close. On the other hand, the centrifugal acceleration may be prevented from having an effect by lowering the gain at the resonance frequency of the vehicle body in a curve section. In this case, however, the damping force for suppressing vibration at the resonance frequency of the vehicle body becomes insufficient, and therefore the passenger comfort of the railway vehicle again deteriorates.

It is therefore an object of this invention to improve passenger comfort of a railway vehicle in a curve section.

In order to achieve the above object, this invention provides a railway vehicle damping device comprising at least two front side vibration suppression force generating sources interposed between a front bogie and a vehicle body of a railway vehicle, at least two rear side vibration suppression force generating sources interposed between a rear bogie and the vehicle body of the railway vehicle, and a programmable controller.

The controller is programmed to determine a yaw suppression force for suppressing vibration in a yaw direction of the vehicle body, suppress vibration of the vehicle body by controlling the front side vibration suppression force generating sources and the rear side vibration suppression force generating sources on the basis of the yaw suppression force, and when the railway vehicle travels in a curve section, cause at least a part of the front side vibration suppression force generating sources and at least a part of the rear side vibration suppression force generating sources to output the yaw suppression force while causing all of the remaining front side vibration suppression force generating sources and all of the remaining rear side vibration suppression force generating sources to function as passive dampers.

The details as well as other features and advantages of this invention are set forth in the remainder of the specification and are shown in the accompanying drawings.

DESCRIPTION OF EMBODIMENTS

Figure 1:
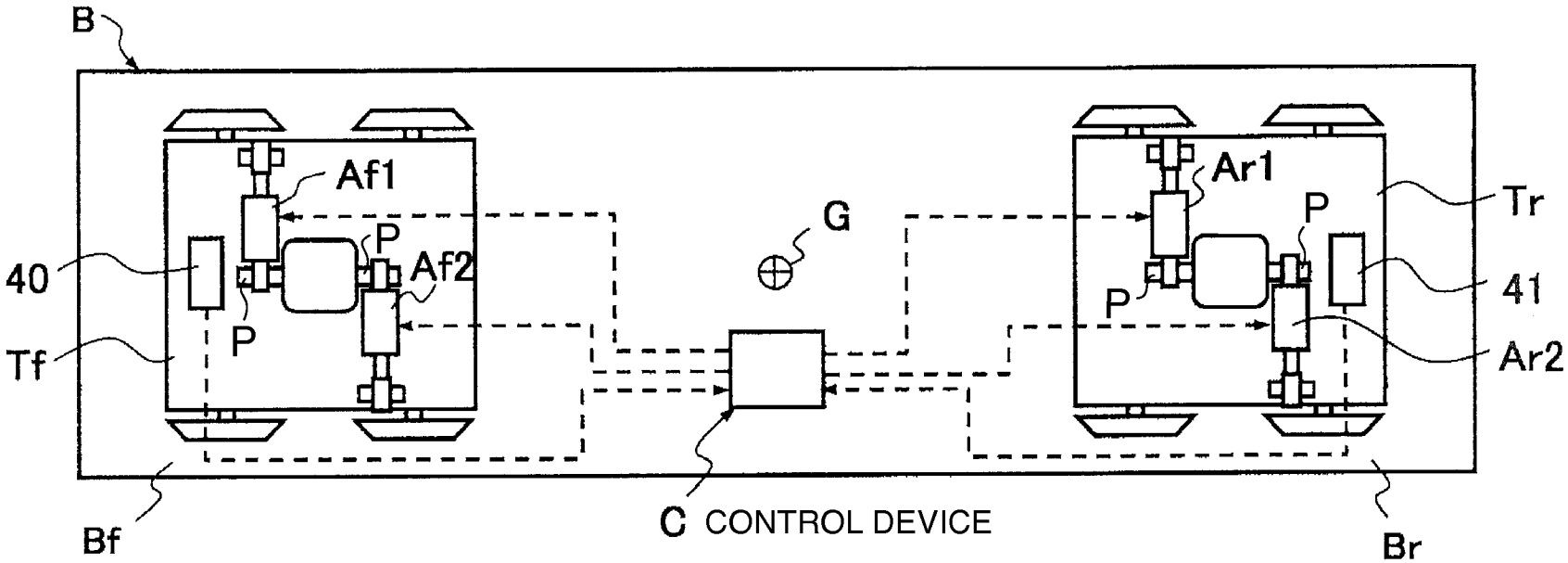
FIG. 1 is a schematic plan view showing a railway vehicle provided with a railway vehicle damping device according to an embodiment of this invention.

Referring to FIG. 1 of the drawings, a railway vehicle damping device 1 according to an embodiment of this invention is used as a damping device for a vehicle body B of a railway vehicle.

The railway vehicle damping device 1 comprises hydraulic actuators Af1, Af2 interposed between a front bogie Tf and the vehicle body B, hydraulic actuators Ar1, Ar2 interposed between a rear bogie Tr and the vehicle body B, and a control device C that controls the actuators Af1, Af2, Ar1, Ar2. More specifically, one end of each of the actuators Af1 and Af2 is coupled to a pin P projecting in a front-rear direction from a front portion Bf of the vehicle body B, and another end is coupled to the front bogie Tf. One end of each of the actuators Ar1 and Ar2 is coupled to another pin P projecting in the front-rear direction from a rear portion Br of the vehicle body B, and another end is coupled to the rear bogie Tr.

The control device C suppresses horizontal vibration of the vehicle body B in a vehicle transverse direction by actively controlling the actuators Af1, Af2, Ar1, Ar2, or in other words by causing the actuators Af1, Af2, Ar1, Ar2 to function as active dampers.

When performing control to suppress the vibration of the vehicle body B, the control device C detects a horizontal acceleration af of the front portion Bf of the vehicle body B in the vehicle transverse direction and a horizontal acceleration ar of the rear portion Br of the vehicle body B in the vehicle transverse direction. The control device C then calculates a yaw acceleration ω, which is an angular acceleration about a vehicle body center G directly above the front and rear bogies Tf, Tf, on the basis of the horizontal acceleration af and the horizontal acceleration ar, and calculates a sway acceleration S, which is an acceleration in a horizontal lateral direction of the center G of the vehicle body B, on the basis of the horizontal acceleration af and the horizontal acceleration ar. Furthermore, the control device C calculates a target yaw suppression force Fωref required to suppress yaw vibration of the entire vehicle body on the basis of the yaw acceleration ω.

The control device C calculates a target sway suppression force FSref required to suppress sway vibration of the entire vehicle body on the basis of the sway acceleration S. Further, the control device C determines whether the railway vehicle is currently traveling in a curve section or a non-curve section.

When the railway vehicle is traveling in a non-curve section, the control device C causes the front side actuator Af1 and the rear side actuator Ar1 to generate a yaw suppression force Fω obtained by multiplying the target yaw suppression force Fωref by ½. Further, the control device C causes the front side actuator Af2 and the rear side actuator Ar2 to generate a sway suppression force FS obtained by multiplying the target sway suppression force FSref by ½.

When the railway vehicle is traveling in a curve section, on the other hand, the control device C causes the front side actuator Af1 and the rear side actuator Ar1 to generate the yaw suppression force Fω obtained by multiplying the target yaw suppression force Fωref by ½, but causes the front side actuator Af2 and the rear side actuator Ar2 to function respectively as passive dampers.

A specific configuration of the front side actuators Af1, Af2 and the rear side actuators Ar1, Ar2 will now be described. The actuators Af1, Af2, Ar1, and Ar2 are all configured identically, and therefore, to avoid redundant description, only the configuration of the actuator Af1 will be described and the description of the other actuators Af2, Ar1, Ar2 will be omitted.

Figure 2:
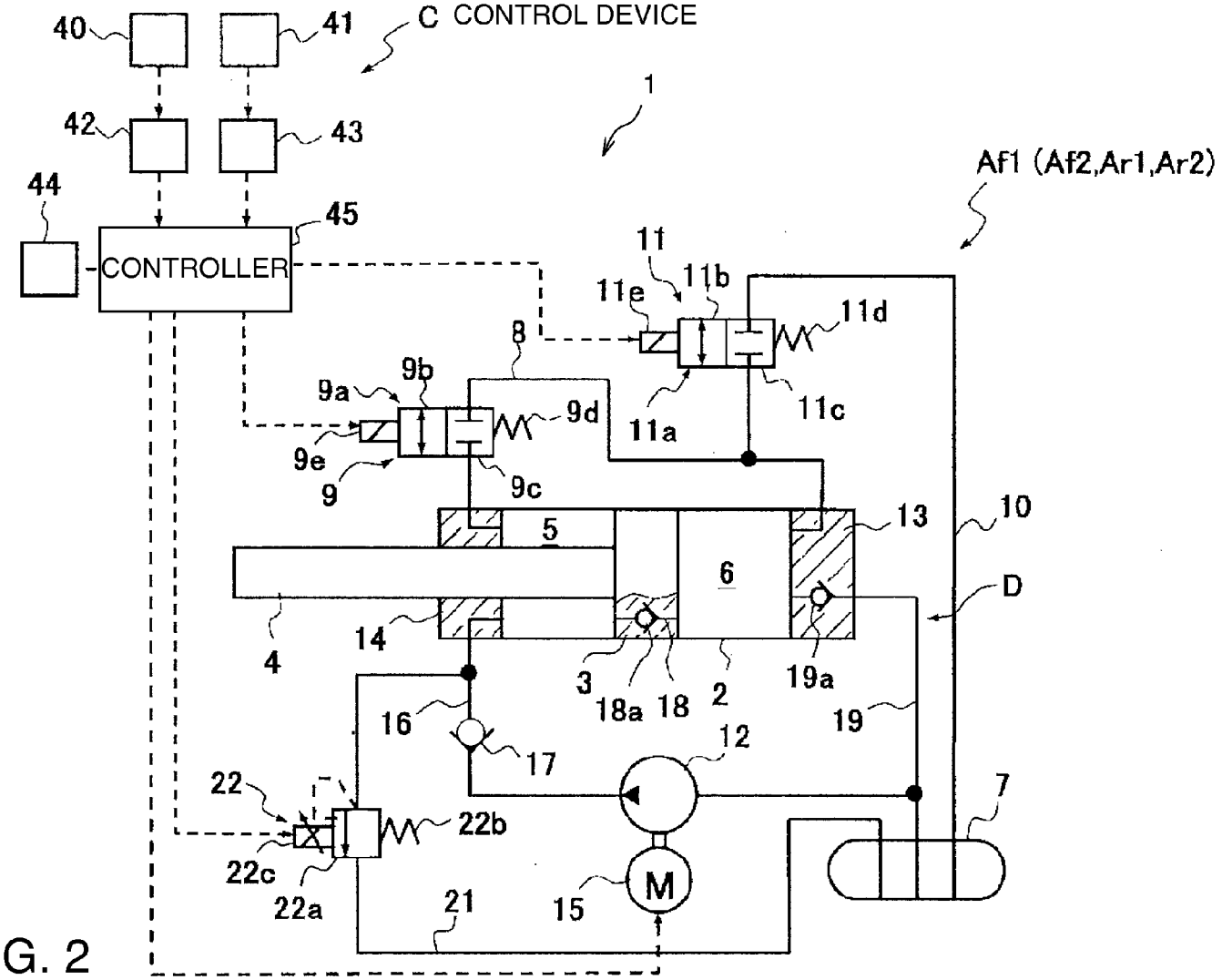
FIG. 2 is a hydraulic circuit diagram of an actuator provided in the railway vehicle damping device.

Referring to FIG. 2, the actuator Af1 is constituted by a single rod type actuator. The actuator Af1 comprises a cylinder 2 coupled to one of the front bogie Tf and the vehicle body B of the railway vehicle, a piston 3 housed in the cylinder 2 to be free to slide, and a rod 4 joined to the piston 3 at one end and coupled to the other of the front bogie Tf and the vehicle body B at another end.

A rod side chamber 5 and a piston side chamber 6 are defined within the cylinder 2 by the piston 3. The rod side chamber 5 and the piston side chamber 6 are filled with working oil. A working oil tank 7 is provided on the outside of the actuator Af1. A gas is charged into the tank 7 in addition to the working oil. It should be noted, however, that there is no need to charge the gas in a compressed condition in order to pressurize the tank 7.

The rod side chamber 5 and the piston side chamber 6 are connected by a first passage 8. A first opening/closing valve 9 is provided in the first passage 8. The piston side chamber 6 and the tank 7 are connected by a second passage 10. A second opening/closing valve 11 is provided in the second passage 10. The working oil is supplied to the rod side chamber 5 from a pump 12. The first passage 8 connects the rod side chamber 5 to the piston side chamber 6 on the exterior of the cylinder 2. However, the first passage 8 may be provided in the piston 3.

The actuator Af1 performs an expansion operation by operating the pump 12 in a condition where the first opening/closing valve 9 is open such that the first passage 8 is opened and the second opening/closing valve 11 is closed such that a flow of the working oil in the second passage 10 is blocked. Further, the actuator Af1 performs a contraction operation by operating the pump 12 in a condition where the second opening/closing valve 11 is open such that the second passage 10 allows a flow of the working oil and the first opening/closing valve 9 is closed such that a flow of the working oil in the first passage 8 is blocked.

The respective parts of the actuator Af1 will now be described in detail. The cylinder 2 is formed in a tubular shape. An end portion of the cylinder 2 on a right side of the figure is closed by a lid 13, and an annular rod guide 14 is fixed to another end portion of the cylinder 2 on a left side of the figure. The rod guide 14 supports the rod 4 inserted into the cylinder 2 to be free to slide. One end of the rod 4 projects from the cylinder 2 to an axial direction outer side, and another end of the rod 4 is coupled to the piston 3 within the cylinder 2.

A space between an outer periphery of the rod 4 and the cylinder 2 is sealed by a seal member such that the interior of the cylinder 2 is maintained in an airtight condition. As described above, the working oil fills the rod side chamber 5 and the piston side chamber 6 defined within the cylinder 2 by the piston 3. However, any other liquid suitable for an actuator may be used instead of the working oil.

In the actuator Af1, a sectional area of the rod 4 is set at a half of a sectional area of the piston 3. As a result, a pressure receiving surface area of the piston 3 on the rod side chamber 5 side is half a pressure receiving surface area of the piston 3 on the piston side chamber 6 side. Hence, when a pressure in the rod side chamber 5 is identical during the expansion operation and the contraction operation of the actuator Af1, an identical thrust is generated in expansion and contraction directions. Further, an amount of supplied working oil relative to a displacement amount of the actuator Af1 is identical in both expansion and contraction directions.

More specifically, when the actuator Af1 is caused to perform the expansion operation, the rod side chamber 5 and the piston side chamber 6 communicate with each other. As a result, the pressure in the rod side chamber 5 becomes equal to a pressure in the piston side chamber 6, and therefore an expansion side thrust obtained by multiplying the pressure by a pressure receiving surface area difference between the rod side chamber 5 side and the piston side chamber 6 side of the piston 3 is generated. Conversely, when the actuator Af1 is caused to perform the contraction operation, communication between the rod side chamber 5 and the piston side chamber 6 is blocked, and the piston side chamber 6 is open to the tank 7. As a result, a contraction side thrust obtained by multiplying the pressure in the rod side chamber 5 by the pressure receiving surface area of the piston 3 on the rod side chamber 5 side is generated. Hence, during both expansion and contraction, the thrust generated by the actuator Af1 takes a value obtained by multiplying the pressure in the rod side chamber 5 by a half of the sectional area of the piston 3.

Therefore, the control device C can control the thrust of the actuator Af1 by controlling the pressure of the rod side chamber 5 during both the expansion operation and the contraction operation. When the pressure receiving surface area on the rod side chamber 5 side of the piston 3 is set at half the pressure receiving surface area on the piston side chamber 6 side in this manner, the pressure of the rod side chamber 5 for generating equal thrust in both the expansion and contraction directions is equal in both the expansion and contraction directions, and therefore the control is easy. Further, the amount of supplied working oil relative to the displacement amount of the piston 3 is also equal regardless of a displacement direction, and therefore an identical response can be obtained during operations in both the expansion and contraction directions. Even when the pressure receiving surface area of the piston 3 in the rod side chamber 5 is not set at half the pressure receiving surface area in the piston side chamber 6, the thrust of the actuator Af1 on both the expansion and contraction sides can be controlled using the pressure in the rod side chamber 5.

A tip end of the rod 4 and the lid 13 that closes a base end of the cylinder 2 are provided with attachment portions, not shown in the figures. The actuator Af1 is interposed between the vehicle body B and the front bogie Tf of the railway vehicle via these attachment portions.

The first opening/closing valve 9 is constituted by a solenoid opening/closing valve. The first opening/closing valve 9 comprises a valve body 9*a*, a spring 9*d*, and a solenoid 9*e*. The valve body 9*a* displaces between a communication position 9*b* in which the rod side chamber 5 communicates with the piston side chamber 6 via the first passage 8, and a blocking position 9*c* in which communication between the rod side chamber 5 and the piston side chamber 6 is blocked. The spring 9*d* biases the valve body 9*a* toward the blocking position 9*c*. The solenoid 9*e*, when energized, drives the valve body 9*a* to the communication position 9*b* against the spring 9*d*.

The second opening/closing valve 11 is constituted by a solenoid opening/closing valve. The second opening/closing valve 11 comprises a valve body 11*a*, a spring 11*d*, and a solenoid 11*e*. The valve body 11*a* displaces between a communication position 11*b* in which the piston side chamber 6 communicates with the tank 7 via the second passage 10, and a blocking position 11*c* in which communication between the piston side chamber 6 and the tank 7 is blocked. The spring 11*d* biases the valve body 11*a* toward the blocking position 11*c*. The solenoid 11*e*, when energized, drives the valve body 11*a* to the communication position 11*b* against the spring 11*d*.

An electric motor 15 drives the pump 12 to rotate. The pump 12 discharges the working oil in only one direction. A discharge port of the pump 12 communicates with the rod side chamber 5 via a supply passage 16. A suction port of the pump 12 communicates with the tank 7. When driven to rotate by the electric motor 15, the pump 12 suctions the working oil from the tank 7 and supplies the rod side chamber 5 with pressurized working oil.

Since the pump 12 discharges the working oil in only one direction, an operation to switch a rotation direction thereof is not required. Hence, a problem whereby a discharge amount varies when the rotation direction is switched does not arise, and therefore an inexpensive gear pump or the like can be used. Further, the rotation direction of the pump 12 is always the same direction, and therefore the electric motor 15 that drives the pump 12 does not require a high degree of responsiveness with respect to a rotation direction switch. Hence, an inexpensive motor may likewise be used as the electric motor 15. A check valve 17 that prevents a reverse flow of the working oil from the rod side chamber 5 to the pump 12 is provided in the supply passage 16.

When the actuator Af1 is caused to perform the expansion operation by supplying a predetermined discharge flow from the pump 12 to the rod side chamber 5, the pressure in the rod side chamber 5 is adjusted by performing control to open and close the second opening/closing valve 11 while opening the first opening/closing valve 9. When the actuator Af1 is caused to perform the contraction operation, the pressure in the rod side chamber 5 is adjusted by performing control to open and close the first opening/closing valve 9 opening the second opening/closing valve 11. In so doing, a thrust corresponding to the suppression force calculated by the control device C is obtained.

During the expansion operation of the actuator Af1, the rod side chamber 5 and the piston side chamber 6 communicate with each other such that the pressure in the piston side chamber 6 is equal to the pressure in the rod side chamber 5. Hence, the thrust can be controlled by controlling the pressure in the rod side chamber 5 during both the expansion operation and the contraction operation. The first opening/closing valve 9 and the second opening/closing valve 11 may also be constituted by opening/closing variable relief valves having a relief pressure adjustment function. In this case, the thrust of the actuator Af1 is controlled by adjusting a valve opening pressure of the first opening/closing valve 9 or the second opening/closing valve 11 rather than causing the actuator Af1 to expand and contract by performing an opening/closing operation on the first opening/closing valve 9 or the second opening/closing valve 11.

To facilitate thrust adjustment by the actuator Af1, the railway vehicle damping device 1 comprises a tank passage 21 that connects the rod side chamber 5 to the tank 7, and a variable relief valve 22 provided in the tank passage 21 to be capable of modifying a relief pressure.

The variable relief valve 22 is constituted by a proportional solenoid relief valve. The variable relief valve 22 comprises a valve body 22*a* provided in the tank passage 21, a spring 22*b* that biases the valve body 22*a* in a direction for blocking the tank passage 21, and a proportional solenoid 22*c* which, when energized, applies a thrust to the valve body 22*a* against the spring 22*b*. The control device C controls the relief pressure by controlling a current amount flowing to the proportional solenoid 22*c*.

In the variable relief valve 22, when the pressure in the rod side chamber 5 exceeds the relief pressure, a resultant force of the pressure in the rod side chamber 5 and the thrust generated by the proportional solenoid 22*c*, which is exerted on the valve body 22*a*, overcomes a biasing force of the spring 22*b*, thereby driving the valve body 22*a* to an open position such that the tank passage 21 is opened.

In the variable relief valve 22, the thrust generated by the proportional solenoid 22*c* can be increased by increasing the current amount supplied to the proportional solenoid 22*c*. In other words, when the current amount supplied to the proportional solenoid 22*c* is set at a maximum, the relief pressure of the variable relief valve 22 reaches a minimum, and when no current is supplied to the proportional solenoid 22*c* at all, the relief pressure reaches a maximum.

By providing the tank passage 21 and the variable relief valve 22, the pressure in the rod side chamber 5 is adjusted to the relief pressure of the variable relief valve 22 during the expansion and contraction operations of the actuator Af1. By setting the relief pressure of the variable relief valve 22 in this way, the pressure in the rod side chamber 5 can be adjusted easily. By providing the tank passage 21 and the variable relief valve 22, the need for a sensor to adjust the thrust of the actuator Af1 can be eliminated. There is also no need to open and close the first opening/closing valve 9 and the second opening/closing valve 11 at high speed, and no need to form the first opening/closing valve 9 and the second opening/closing valve 11 from variable relief valves having an opening/closing function. As a result, a manufacturing cost of the railway vehicle damping device 1 can be reduced, and a robust damping system in terms of both hardware and software can be constructed.

By forming the variable relief valve 22 from a proportional solenoid relief valve in which the relief pressure can be controlled proportionally in accordance with the applied current amount, the relief pressure can be controlled easily. However, as long as the relief pressure can be adjusted, a valve other than a proportional solenoid relief valve may be used as the variable relief valve 22.

When the pressure in the rod side chamber 5 exceeds the relief pressure, the variable relief valve 22 opens the tank passage 21 regardless of the open/closed condition of the first opening/closing valve 9 and the second opening/closing valve 11 such that the rod side chamber 5 communicates with the tank 7. As a result, the excessive pressure in the rod side chamber 5 is released into the tank 7. By providing the tank passage 21 and the variable relief valve 22, the entire system can be protected against excessive input into the actuator Af1, for example.

The actuator Af1 comprises a damper circuit D. The damper circuit D causes the actuator Af1 to function as a damper when the first opening/closing valve 9 and the second opening/closing valve 11 are both closed. The damper circuit D comprises a one-way passage 18 that allows the working oil to flow only from the piston side chamber 6 toward the rod side chamber 5, and a suction passage 19 that allows the working oil to flow only from the tank 7 toward the piston side chamber 6. Further, the variable relief valve 22 provided in the tank passage 21 functions as a damping valve.

More specifically, the one-way passage 18 allows the working oil to flow only from the piston side chamber 6 toward the rod side chamber 5 using a check valve 18*a* provided therein. The suction passage 19 allows the working oil to flow only from the tank 7 toward the piston side chamber 6 using a check valve 19*a* provided therein. By replacing the blocking position 9*c* of the first opening/closing valve 9 with a check valve that allows the working oil to flow only from the piston side chamber 6 toward the rod side chamber 5, the one-way passage 18 may be omitted. Further, by replacing the blocking position 11*c* of the second opening/closing valve 11 with a check valve that allows the working oil to flow only from the tank 7 toward the piston side chamber 6, the suction passage 19 may be omitted.

When the first opening/closing valve 9 is in the blocking position 9*c* and the second opening/closing valve 11 is in the blocking positions 11*c*, the one-way passage 18, the tank passage 21, and the suction passage 19 of the damper circuit D provided in the actuator Af1 form a circulation passage passing through the piston side chamber 6, the rod side chamber 5, and the tank 7. Herein, the one-way passage 18, the suction passage 19, and the tank passage 21 are all one-way passages. Therefore, when the actuator Af1 is caused to expand and contract by an external force, working oil from the cylinder 2 is always discharged to the tank 7 through the tank passage 21, while a working oil deficiency in the cylinder 2 is alleviated by supplying working oil to the cylinder 2 from the tank 7 through the suction passage 19. The variable relief valve 22 serves as resistance to this flow of working oil such that the pressure in the cylinder 2 is regulated to the relief pressure. In other words, the variable relief valve 22 functions as a pressure control valve, and the actuator Af1 functions as a uniflow passive damper.

Hence, the actuator Af1 is configured to function as both an actuator and a passive damper. It should be noted that, instead of providing the variable relief valve 22 and the tank passage 21, the damper circuit D may be formed by providing a passage that connects the rod side chamber 5 and the tank 7 and providing a damping valve in this passage.

During a failure in which the respective components of the actuator Af1 cannot be energized, the valve body 9*a* of the first opening/closing valve 9 is pushed by the spring 9*d* so as to be held in the blocking position 9*c*, and the valve body 11*a* of the second opening/closing valve 11 is pushed by the spring 11*d* so as to be held in the blocking position 11*c*. The variable relief valve 22, meanwhile, functions as a pressure control valve in which the relief pressure is fixed at a maximum. Accordingly, the actuator Af1 functions as a passive damper. When the actuator Af1 functions as a passive damper, the variable relief valve 22 functions as a damping valve. Hence, a damping characteristic obtained in a case where the actuator Af1 is caused to function as a passive damper can be set as desired by setting the relief pressure of the variable relief valve 22 when the current amount is zero.

To cause the actuators Af1, Af2, Ar1, Ar2 configured as described above to generate a thrust in the expansion direction, the control device C rotates the electric motor 15 with respect to each of the actuators Af1, Af2, Ar1, Ar2 to supply working oil from the pump 12 into the cylinder 2 while setting the first opening/closing valve 9 in the communication position 9*b* and setting the second opening/closing valve 11 in the blocking position 11*c*. Through this operation, the working oil is supplied to the actuators Af1, Af2, Ar1, Ar2 from the pump 12 while the rod side chambers 5 and the piston side chambers 6 of the respective actuators Af1, Af2, Ar1, Ar2 communicate with each other, and therefore the piston 3 is pushed leftward in FIG. 2. As a result, the actuators Af1, Af2, Ar1, Ar2 respectively generate a thrust in the expansion direction.

When the pressure in the rod side chamber 5 and the piston side chamber 6 exceeds the relief pressure of the variable relief valve 22, the variable relief valve 22 opens such that the working oil flows out into the tank 7 through the tank passage 21. Accordingly, the pressure in the rod side chamber 5 and the piston side chamber 6 is maintained at the relief pressure of the variable relief valve 22, which is determined by the current amount applied to the variable relief valve 22. The thrust generated by the respective actuators Af1, Af2, Ar1, Ar2 is equal to a value obtained by multiplying the pressure in the rod side chamber 5 by the pressure receiving surface area difference between the rod side chamber 5 side and the piston side chamber 6 side of the piston 3.

To cause the actuators Af1, Af2, Ar1, Ar2 to generate a thrust in the contraction direction, on the other hand, the control device C rotates the electric motor 15 with respect to each of the actuators Af1, Af2, Ar1, Ar2 to supply working oil from the pump 12 into the rod side chamber 5 while setting the first opening/closing valve 9 in the blocking position 9*c* and setting the second opening/closing valve 11 in the communication position 11*b*. The working oil is thereby supplied to the rod side chamber 5 from the pump 12 while the piston side chamber 6 communicates with the tank 7, and the piston 3 is pushed in a rightward direction of FIG. 2. As a result, the actuators Af1, Af2, Ar1, Ar2 respectively generate a thrust in the contraction direction. The thrust generated by the respective actuators Af1, Af2, Ar1, Ar2 is equal to a value obtained by multiplying the pressure in the rod side chamber 5 by the pressure receiving surface area of the piston 3 on the rod side chamber 5 side.

The actuators Af1, Af2, Ar1, Ar2 can be caused to function as passive dampers as well as actuators, or in other words active dampers, regardless of a driving condition of the electric motor 15 simply by performing an opening/closing operation on the first opening/closing valve 9 and the second opening/closing valve 11. The actuators Af1, Af2, Ar1, Ar2 can be switched between actuators and passive dampers easily, leading to improvements in a response and a reliability of the railway vehicle damping device 1.

Since the single rod type actuators are used as the actuators Af1, Af2, Ar1, Ar2, a longer stroke length is obtained than in the case of double rod type actuators, and therefore an overall length of the actuators is shortened. As a result, the actuators Af1, Af2, Ar1, Ar2 can be installed in the railway vehicle more easily.

The working oil that flows into the rod side chamber 5 from the pump 12 in the actuators Af1, Af2, Ar1, Ar2 passes through the piston side chamber 6 and is finally recirculated to the tank 7. Therefore, even when gas is intermixed into the rod side chamber 5 or the piston side chamber 6, the gas is discharged into the tank 7 by the expansion and contraction operations of the actuators Af1, Af2, Ar1, Ar2. As a result, a reduction in response during thrust generation can be prevented. Further, frequent maintenance operations for maintaining the performance of the actuators Af1, Af2, Ar1, Ar2 are not required, and therefore labor and costs expended on maintenance can be reduced.

Moreover, during manufacture of the actuators Af1, Af2, Ar1, Ar2, troublesome operations such as assembling the actuators Af1, Af2, Ar1, Ar2 in oil or in a vacuum environment are not required, and an advanced degassing operation need not be performed on the working oil. As a result, the actuators Af1, Af2, Ar1, Ar2 can be manufactured with high productivity, and manufacturing costs can be reduced.

The control device C comprises a front side acceleration sensor 40 that detects the horizontal acceleration af of the vehicle body front portion Bf in the vehicle lateral direction, a rear side acceleration sensor 41 that detects the horizontal acceleration ar of the vehicle body rear portion Br in the vehicle lateral direction, a band pass filter 42 that removes noise included in the horizontal acceleration af, a band pass filter 43 that removes noise included in the horizontal acceleration ar, and a locus information acquisition unit 44 that detects a travel locus of the railway vehicle.

The control device C comprises a controller 45 that determines whether or not the railway vehicle is traveling in a curve section on the basis of the travel locus detected by the locus information acquisition unit 44, and in accordance with a determination result, outputs control commands respectively to the electric motor 15, the solenoid 9*e* of the first opening/closing valve 9, the solenoid 11*e* of the second opening/closing valve 11, and the proportional solenoid 22*c* of the variable relief valve 22 of each of the actuators Af1, Af2, Ar1, Ar2.

The controller 45 is constituted by a microcomputer comprising a central processing unit (CPU), a read only memory (ROM), a random access memory (RAM), and an input/output interface (I/O interface). The controller 45 may be constituted by a plurality of microcomputers.

The control device C configured as described above controls the thrust of the respective actuators Af1, Af2, Ar1, Ar2. For this purpose, the controller 45 calculates the target yaw suppression force Fωref and the target sway suppression force FSref by performing H-infinity control to apply a frequency weighting. The band pass filters 42 and 43 may therefore be omitted.

The locus information acquisition unit 44 is constituted by a central vehicle monitor disposed in a certain specific carriage of a coupled cars of the railway vehicle, or a vehicle monitor terminal connected thereto, and is used to obtain information indicating the travel locus of the railway vehicle in real time. The locus information acquisition unit 44 is not limited to a vehicle monitor, and may be constructed using a Global Positioning System (GPS) or the like.

Figure 3:
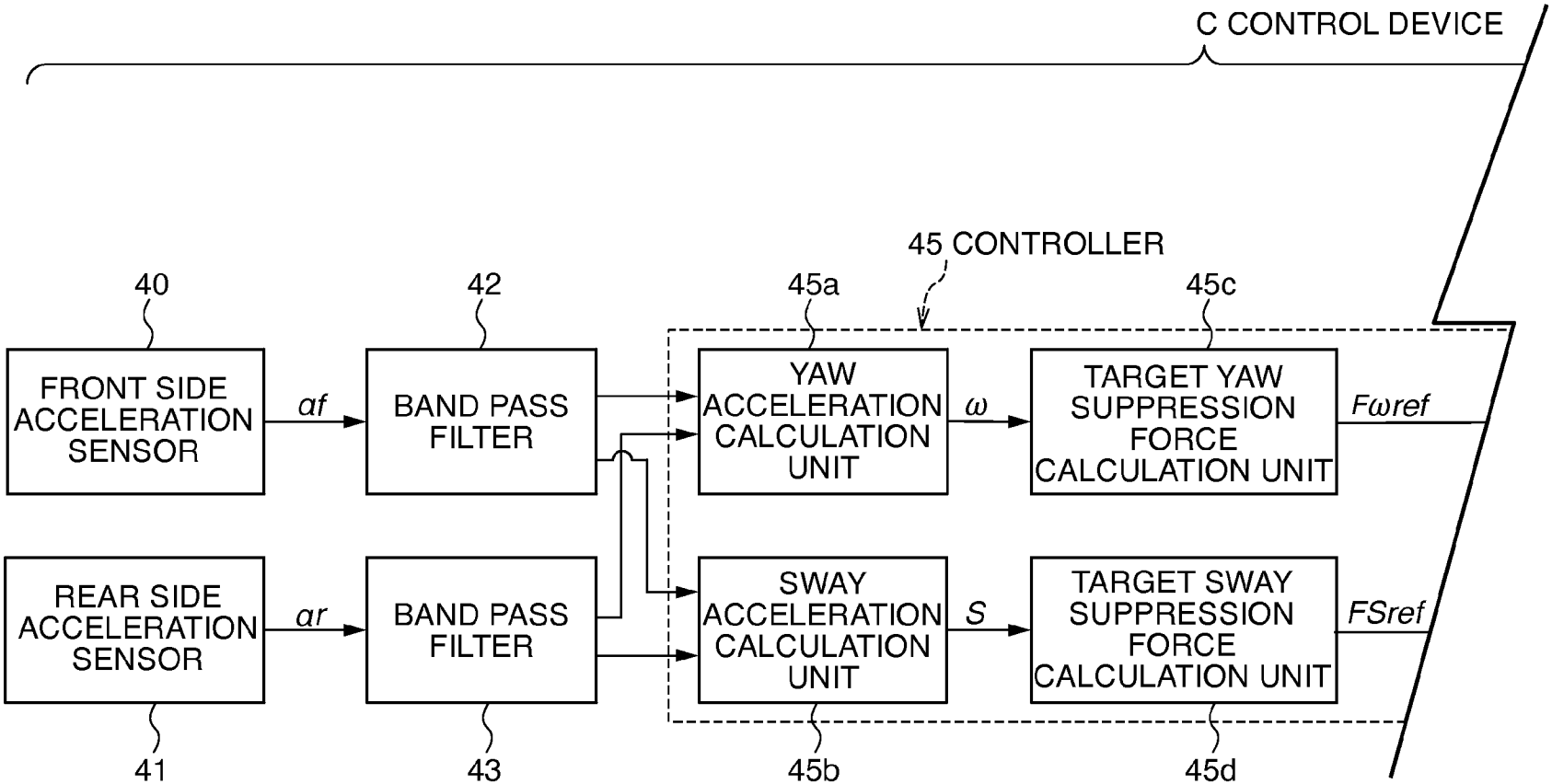
FIG. 3 is a block diagram showing a part of control functions of a controller provided in the railway vehicle damping device.
Figure 4:
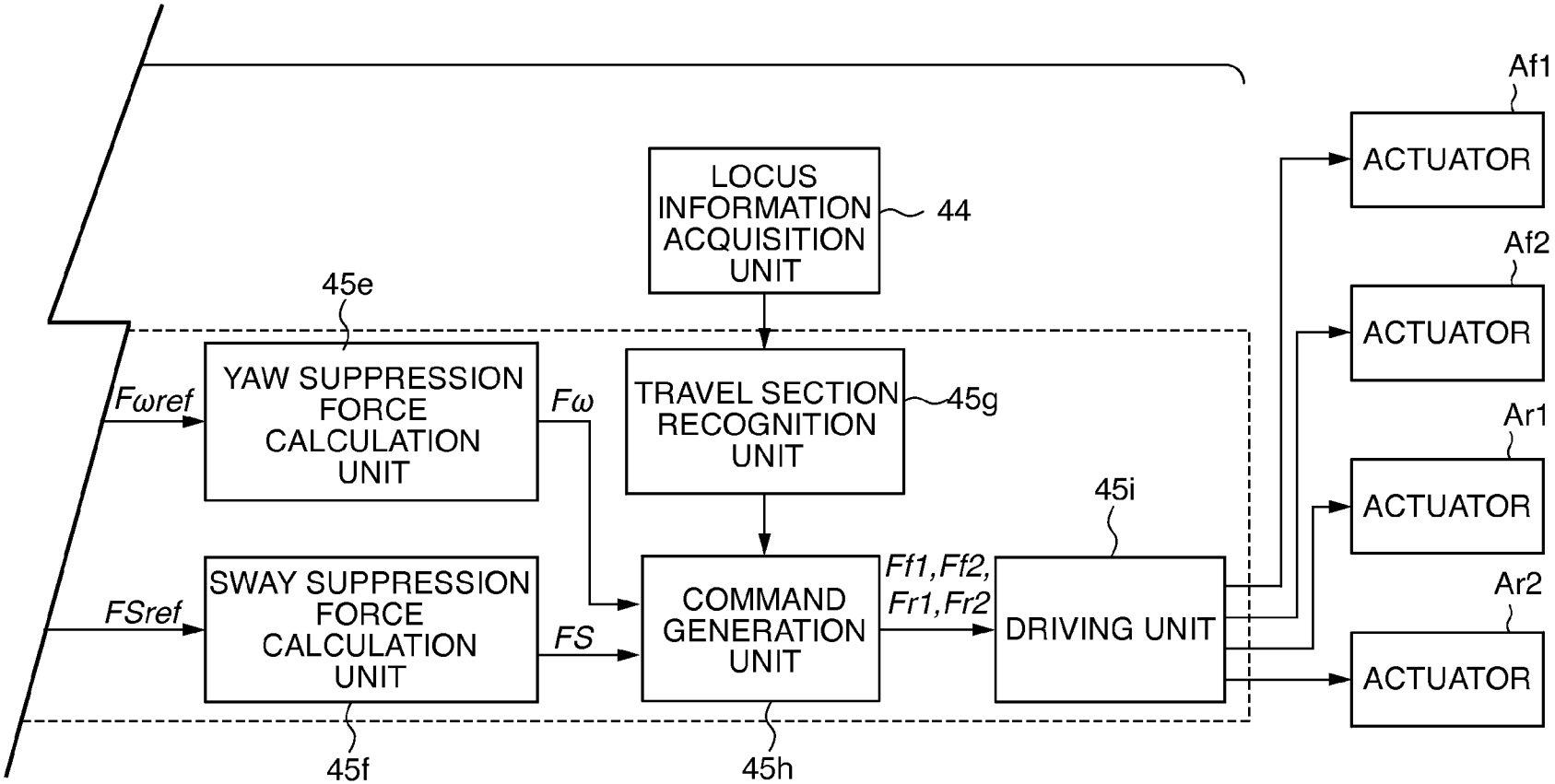
FIG. 4 is a block diagram showing a remaining part of the control functions of the controller.

Referring to FIGS. 3 and 4, the controller 45 comprises a yaw acceleration calculation unit 45*a*, a sway acceleration calculation unit 45*b*, a target yaw suppression force calculation unit 45*c*, a target sway suppression force calculation unit 45*d*, a yaw suppression force calculation unit 45*e*, a sway suppression force calculation unit 45*f*, a travel section recognition unit 45*g*, a command generation unit 45*h*, and a driving unit 45*i*.

The yaw acceleration calculation unit 45*a* calculates the yaw acceleration ω about a center G of the vehicle body directly above the front bogie Tf and the rear bogie Tr on the basis of the horizontal acceleration af of the vehicle front portion Bf, detected by the front side acceleration sensor 40, and the horizontal acceleration ar of the vehicle rear portion Br, detected by the rear side acceleration sensor 41.

The sway acceleration calculation unit 45*b* calculates the sway acceleration S of the center G of the vehicle body B on the basis of the horizontal acceleration af and the horizontal acceleration ar.

The target yaw suppression force calculation unit 45*c* calculates the target yaw suppression force Fωref required to suppress yawing of the entire vehicle body B on the basis of the yaw acceleration ω.

The target sway suppression force calculation unit 45*d* calculates the target sway suppression force FSref required to suppress swaying of the entire vehicle body B on the basis of the sway acceleration S.

The yaw suppression force calculation unit 45*e* calculates the yaw suppression force Fω by multiplying the target yaw suppression force Fωref calculated by the target yaw suppression force calculation unit 45*c* by ½.

The sway suppression force calculation unit 45*f* calculates the sway suppression force FS by multiplying the target sway suppression force FSref calculated by the target sway suppression force calculation unit 45*d* by ½.

The travel section recognition unit 45*g* determines whether or not the current travel section of the railway vehicle corresponds to a curve section from the travel locus detected by the locus information acquisition unit 44.

The command generation unit 45*h* generates control commands Ff1, Ff2, Fr1, Fr2 to be applied respectively to the actuators Af1, Af2, Ar1, Ar2 from a determination result of the travel section recognition unit 45*g*, the yaw suppression force Fω, and the sway suppression force FS.

The driving unit 45*i* supplies corresponding currents to the electric motor 15, the solenoid 9*e* of the first opening/closing valve 9, the solenoid 11*e* of the second opening/closing valve 11, and the proportional solenoid 22*c* of the variable relief valve 22 on the basis of the control commands Ff1, Ff2, Fr1, Fr2.

All of the blocks 45*a* to 45*g* shown in the FIGS. 3 and 4 are virtual units for the purpose of describing the function of the controller 45, and do not exist as physical entities.

As hardware resources, the control device C also comprises an A/D converter, not shown in the figures, for importing signals output by the front side acceleration sensor 40 and the rear side acceleration sensor 41, and so on. The band pass filters 42, 43 may be realized by software programmed into the controller 45.

The horizontal accelerations af and ar are set to be positive when oriented upward in FIG. 1 and negative when oriented downward in FIG. 1, for example. The yaw acceleration calculation unit 45*a* calculates the yaw acceleration ω about the center G of the vehicle body B above the front bogie Tf and the rear bogie Tr by calculating a difference between the horizontal acceleration af of the vehicle front portion Bf and the horizontal acceleration ar of the vehicle rear portion Br and dividing the difference by two.

The sway acceleration calculation unit 45*b* calculates the sway acceleration S of the center G of the vehicle body B by calculating a sum of the horizontal acceleration af and the horizontal acceleration ar and dividing the sum by two.

To calculate the yaw acceleration ω, locations of the front side acceleration sensor 40 and the rear side acceleration sensor 41 are preferably set as follows. The front side acceleration sensor 40 is disposed in the vicinity of the front side actuators Af1 and Af2 on a line extending in a front-aft direction or a diagonal direction and passing through the center G of the vehicle body B. The rear side acceleration sensor 41 is disposed in the vicinity of the rear side actuators Ar1 and Ar2 on a line passing through the center G of the vehicle body B and the position of the front side acceleration sensor 40.

The yaw acceleration ω can be calculated from respective distances and positional relationships between the center G of the vehicle body B and the front and rear side acceleration sensors 40, 41, and the horizontal accelerations af, ar. The front side acceleration sensor 40 and the rear side acceleration sensor 41 may therefore be disposed arbitrarily. In this case, however, the yaw acceleration ω cannot be calculated simply by calculating the difference between the horizontal acceleration af and the horizontal acceleration ar and dividing the difference by two. Instead, the yaw acceleration ω must be calculated from the difference between the horizontal acceleration af and the horizontal acceleration ar, and the respective distances and positional relationships between the center G of the vehicle body B and the acceleration sensors 40, 41.

The target yaw suppression force calculation unit 45*c* calculates the target yaw suppression force Fωref, which is the suppression force required to suppress yawing of the entire vehicle body, by performing H-infinity control on the basis of the yaw acceleration ω calculated by the yaw acceleration calculation unit 45*a*. More specifically, the target yaw suppression force calculation unit 45*c* performs frequency shaping on the input yaw acceleration ω using a weighting function, and calculates an optimum target yaw suppression force Fωref for suppressing yaw vibration in a frequency band that is to be suppressed most urgently, from the yaw vibration of the entire vehicle body. The weighting function is designed to be suitable for the railway vehicle.

The target sway suppression force calculation unit 45*d* calculates the target sway suppression force FSref, which is the suppression force required to suppress swaying of the entire vehicle body, by performing H-infinity control on the basis of the sway acceleration S calculated by the sway acceleration calculation unit 45*b*. More specifically, the target sway suppression force calculation unit 45*d* performs frequency shaping on the input sway acceleration S using a weighting function, and calculates an optimum target sway suppression force FSref for suppressing sway vibration in a frequency band that is to be suppressed most urgently, from the sway vibration of the entire vehicle body. The weighting function is designed to be suitable for the railway vehicle.

The yaw suppression force calculation unit 45*e* calculates the yaw suppression force Fω to be output by the front side actuator Af1 and the rear side actuator Ar1 from the target yaw suppression force Fωref obtained by the target yaw suppression force calculation unit 45*c*. The target yaw suppression force Fωref is a suppression force for suppressing the yaw direction vibration of the entire vehicle body B, and since the yawing of the vehicle body B is suppressed by the thrust output by two actuators, namely the front side actuator Af1 and the rear side actuator Ar1, the yaw suppression force Fω output by the front side actuator Af1 and the rear side actuator Ar1 is calculated by dividing the value of the target yaw suppression force Fωref by two.

Yawing is horizontal rotation of the vehicle body B, and the front side actuator Af1 and the rear side actuator Ar1 must generate a couple in order to suppress the yaw direction vibration of the vehicle body B. A symbol of the yaw suppression force Fω of the front side actuator Af1 is opposite to a symbol of the yaw suppression force Fω of the rear side actuator Ar1. In other words, when the yaw suppression force Fω of the front side actuator Af1 is X, the yaw suppression force Fω of the rear side actuator Ar1 is -X. Further, the yaw suppression force Fω is generated by the two actuators Af1, Ar1, and therefore the value multiplied to obtain the yaw suppression force Fω from the target yaw suppression force Fωref is ½. The multiplied value depends on the number of actuators.

For example, when the yaw suppression force Fω is generated by two front side actuators and three rear side actuators, first, the target yaw suppression force Fωref is multiplied by ½ so that the yaw suppression force to be output by all of the front side actuators and the yaw suppression force to be output by all of the rear side actuators have equal values and opposite symbols. Next, since there are two front side actuators, a further multiplication by half is implemented. In other words, the yaw suppression force Fω of one front side actuator takes a value obtained by multiplying the target yaw suppression force Fωref by ¼. The yaw suppression force Fω of one rear side actuator, meanwhile, is determined as follows. The number of rear side actuators is three, and therefore the yaw suppression force to be output by all of the rear side actuators is multiplied by ⅓. In other words, the yaw suppression force Fω of one rear side actuator takes a value obtained by multiplying the target yaw suppression force Fωref by ⅙.

It should be noted the obtained yaw suppression forces Fω have different symbols on the front side actuators and the rear side actuators.

The sway suppression force calculation unit 45*f* calculates the sway suppression force FS to be output by the front side actuator Af2 and the rear side actuator Ar2 from the target sway suppression force FSref obtained by the target sway suppression force calculation unit 45*d*. The target sway suppression force FSref is a suppression force for suppressing the sway direction vibration of the entire vehicle body B, and the swaying of the vehicle body B is suppressed by the thrust output by the front side actuator Af2 and the rear side actuator Ar2. Accordingly, the sway suppression force FS output by the front side actuator Af2 and the rear side actuator Ar2 is calculated by multiplying the value of the target sway suppression force FSref by ½.

The two actuators Af2 and Ar2 generate the sway suppression force FS, and therefore the value multiplied to obtain the sway suppression force FS from the target sway suppression force FSref is ½. The multiplied value depends on the number of actuators.

For example, when the sway suppression force FS is generated by three front side actuators and four rear side actuators, first, since the sway suppression force to be output by all of the front side actuators and the sway suppression force to be output by all of the rear side actuators have identical values, these sway suppression forces are calculated by multiplying the target sway suppression force FSref by ½. Further, since there are three front side actuators, the sway suppression force of one front side actuator is obtained by multiplying the sway suppression force to be output by all of the front side actuators by ⅓. As a result, the sway suppression force FS of one front side actuator takes a value obtained by multiplying the target sway suppression force FSref by ⅙. As regards the sway suppression force FS of the rear side actuators, meanwhile, the number of rear side actuators is four, and therefore the sway suppression force to be output by all of the rear side actuators is multiplied by ¼. As a result, the sway suppression force FS of one rear side actuator takes a value obtained by multiplying the target sway suppression force FSref by ⅛.

The travel section recognition unit 45*g* determines whether the current travel section of the railway vehicle is a curve section or non-curve section from the travel locus detected by the locus information acquisition unit 44, and outputs a determination result to the command generation unit 45*h*. More specifically, for example, the travel section recognition unit 45*g* comprises a map on which travel loci are associated with travel section information, and determines whether or not the current travel section is a curve section from a travel locus of the railway vehicle by referring to the map.

Alternatively, transmitters that issue signals may be provided on a boundary between a curve section and a non-curve section or at a front end and rear end of a curve section, and a receiver that receives the signals from the transmitters may be provided on the railway vehicle side as a locus information acquisition unit. In this case, the travel section recognition unit 45*g* recognizes that the railway vehicle has entered a curve section upon reception of a signal from a transmitter disposed at an entrance to the curve section, and determines that the railway vehicle has left the curve section and entered a non-curve section upon reception of a signal from a transmitter disposed at an exit from the curve section.

Basically, the travel section recognition unit 45*g* may take any form as long as it is capable of recognizing that the railway vehicle is traveling in a curve section. To maintain favorable passenger comfort during travel in a curve section, the railway vehicle damping device 1 preferably switches from control executed in the non-curve section to control executed in the curve section before the railway vehicle actually enters the curve section. For this purpose, a point for determining that the railway vehicle has entered the curve section is preferably set in a linear section before an actual curve start. Similarly, a point for determining that the railway vehicle has left a curve section and entered a non-curve section is preferably set in a linear section after an actual curve end.

Furthermore, the travel section information associated with the travel loci preferably includes information for setting a damping coefficient when the actuators Af2 and Ar2 are caused to function as passive dampers in addition to the information for determining whether the travel section is a curve section or not. This information includes information relating to characteristics of the curve section such as a cant and a curvature of the curve section, whether the curve section is a transition curve or a steady curve, a pattern and a slack of the curve when the curve section is a transition curve, and so on.

The command generation unit 45*h* calculates the control commands Ff1, Ff2, Fr1, Fr2 to be applied respectively to the actuators Af1, Af2, Ar1, Ar2 from the determination result of the travel section recognition unit 45*g*, the yaw suppression force Fω, and the sway suppression force FS.

Specifically, when the result of the determination made by the travel section recognition unit 45*g* indicates that the railway vehicle is traveling in a non-curve section, the command generation unit 45*h* generates the control command Ff1 to cause the front side actuator Af1 to output the yaw suppression force Fω calculated by the yaw suppression force calculation unit 45*e*. The command generation unit 45*h* also generates the control command Fr1 to cause the rear side actuator Ar1 to output the yaw suppression force Fω calculated by the yaw suppression force calculation unit 45*e*. The command generation unit 45*h* also generates the control command Ff2 to cause the front side actuator Af2 to output the sway suppression force FS calculated by the sway suppression force calculation unit 45*f*. The command generation unit 45*h* also generates the control command Fr2 to cause the rear side actuator Ar2 to output the sway suppression force FS calculated by the sway suppression force calculation unit 45*f*.

When the result of the determination made by the travel section recognition unit 45*g* indicates that the railway vehicle is traveling in a curve section, the command generation unit 45*h* generates the control command Ff1 to cause the front side actuator Af1 to output the yaw suppression force Fω calculated by the yaw suppression force calculation unit 45*e*, and generates the control command Fr1 to cause the rear side actuator Ar1 to output the yaw suppression force Fω calculated by the yaw suppression force calculation unit 45*e*. Meanwhile, the command generation unit 45*h* generates the control commands Ff2 and Fr2 to cause the front side actuator Af2 and the rear side actuator Ar2 to function as passive dampers.

The driving unit 45*i* causes the actuators Af1, Af2, Ar1, Ar2 to generate a thrust or to function as passive dampers on the basis of the control commands Ff1, Ff2, Fr1, Fr2. For this purpose, the driving unit 45*i* outputs current commands to the electric motor 15, the solenoid 9*e* of the first opening/closing valve 9, the solenoid 11*e* of the second opening/closing valve 11, and the proportional solenoid 22*c* of the variable relief valve 22 of each of the actuators Af1, Af2, Ar1, Ar2.

In a case where the control commands Ff2 and Fr2 are not the commands to cause the actuators Af2 and Ar2 to function as passive dampers, the driving unit 45*i* generates the current commands Ff1, Ff2, Fr1, Fr2 to be applied to the electric motor 15, the solenoid 9*e* of the first opening/closing valve 9, the solenoid 11*e* of the second opening/closing valve 11, and the proportional solenoid 22*c* of the variable relief valve 22 of each of the actuators Af1, Af2, Ar1, Ar2 in accordance with a generation direction and a magnitude of the thrust of each actuator Af1, Af2, Ar1, Ar2. The current command applied to the proportional solenoid 22*c* may be feed back controlled on the basis of the thrust output by the actuators Af1, Af2, Ar1, Ar2.

Further, in a case where the control commands Ff2 and Fr2 are the commands to cause the actuators Af2 and Ar2 to function as passive dampers, the driving unit 45*i* outputs current commands to the actuators Af2 and Ar2 to set the currents to be applied to the electric motor 15, the solenoid 9*e* of the first opening/closing valve 9, the solenoid 11*e* of the second opening/closing valve 11, and the proportional solenoid 22*c* of the variable relief valve 22 at zero. When the actuators Af2 and Ar2 operate as passive dampers, the working oil is always discharged from the cylinder 2 during both the expansion and contraction direction operations. The discharged working oil is returned to the tank 7 via the tank passage 21. Since the variable relief valve 22By applies a resistance to the flow in the tank passage 21, the actuators Af2 and Ar2 are caused to function as passive dampers during both the expansion and contraction direction operations.

In this case, the current applied to the electric motor 15 may not be set at exactly zero. A rotation speed of the electric motor 15 may be reduced instead to an extent that does not adversely affect functioning of the actuators Af2 and Ar2 as passive dampers. When the railway vehicle enters a non-curve section after traveling through a curve section, the control commands Ff2 and Fr2 are respectively switched to the sway suppression force FS calculated by the sway suppression force calculation unit 45*f*. As a result, the actuators Af2 and Ar2 are returned from a passive damper condition to a condition in which a thrust corresponding to the sway suppression force FS is generated thereby.

When detailed information relating to the curve section, such as the cant and the curvature of the curve section, has been obtained and the actuators Af2 and Ar2 are to be caused to function as passive dampers, the current amount to be applied to the proportional solenoid 22*c* of the variable relief valve 22 may not be determined at zero. It may be set at a value depending on the information indicating the cant, the curvature, and so on such that the damping coefficients of the actuators Af2 and Ar2 may be set at optimum values for the curve section through which the railway vehicle is traveling. For this purpose, either damping coefficients or current amounts to be applied to the proportional solenoid 22*c* of the variable relief valve 22 are associated with curve sections in advance. The damping coefficients of the actuators Af2 and Ar2 are thereby set at optimum values for the respective curve sections through which the railway vehicle travels.

As described above, when the railway vehicle is traveling in a non-curve section, the railway vehicle damping device 1 causes a part of the front and rear actuators Af1, Ar1 to output the yaw suppression force Fω and causes the remaining front and rear actuators Af2, Ar2 to output the sway suppression force FS, and as a result, vibration in both the yaw direction and the sway direction of the vehicle body B can be suppressed, enabling an improvement in passenger comfort.

When the railway vehicle is traveling in a curve section, the railway vehicle damping device 1 causes a part of the front and rear actuators Af1, Ar1 to output the yaw suppression force Fω and causes the remaining front and rear actuators Af2, Ar2 to function as passive dampers. In so doing, the railway vehicle damping device 1 can effectively suppress vibration generated in the yaw direction of the vehicle body B during travel in a curve section using the generated yaw suppression force, while effectively suppressing sway direction vibration using the damping force generated by the passive dampers without being affected by centrifugal acceleration.

According to the railway vehicle damping device 1, therefore, favorable passenger comfort can be realized in the railway vehicle during travel in both a linear section and a curve section.

During travel in a curve section, the acceleration detected by the acceleration sensors 40, 41 comprises centrifugal acceleration. This centrifugal acceleration component cannot be removed completely by filter processing. Therefore, when the actuators Af2 and Ar2 are controlled on the basis of the sway suppression force FS during travel in a curve section, an excessive thrust is generated. Conversely, when a vibration component in a resonance frequency band of the vehicle body B is removed from the acceleration detected by the acceleration sensors 40, 41, the thrust generated by the actuators Af2 and Ar2 to suppress sway direction vibration in the resonance frequency band of the vehicle body B becomes insufficient, leading to deterioration of the passenger comfort.

In the railway vehicle damping device 1, the actuators Af2 and Ar2 function as passive dampers with respect to sway direction vibration in a curve section, and therefore sway direction vibration in the resonance frequency band of the vehicle body B can be suppressed sufficiently. Meanwhile, yaw direction vibration is suppressed effectively by the actuators Af1 and Ar1, which are exclusively used for suppression of the yaw direction vibration, and therefore favorable passenger comfort can be maintained even during travel in a curve section. This effect is exhibited favorably in curve sections constituted by both transition curves and steady curves.

In a non-curve section, it is also possible to cause each of the actuators Af1, Af2, Ar1, Ar2 to generate a thrust obtained by combining the yaw suppression force and the sway suppression force. In this case, when traveling in a curve section, the actuators Af1, Ar1 may be caused to function as passive dampers while the actuators Af2, Ar2 are caused to output the yaw suppression force Fω.

However, by applying the actuators Af1, Ar1, from among the actuators Af1, Af2, Ar1, Ar2, to yaw direction vibration suppression and applying the remaining actuators Af2, Ar2 to sway direction vibration suppression, or in other words causing the actuators Af2, Ar2 to function as passive dampers, control switching need not be performed on the actuators Af1, Ar1. With this configuration, abrupt control command variation can be reduced, and as a result, switching between a curve section vibration suppression mode and a non-curve vibration section suppression mode can be performed smoothly. Moreover, behavior of the vehicle body B during a switch between these vibration suppression modes can be stabilized, enabling a further improvement in the passenger comfort of the railway vehicle.

The railway vehicle damping device 1 is also advantageous in that when an abnormality is found in one of the front and rear actuators Af1, Af2, Ar1, Ar2, the abnormality can be dealt with. For example, when an abnormality occurs in the actuator Af1 that generates the yaw suppression force Fω, the actuator Af1 and the rear side actuator Ar1 that generates the yaw suppression force Fω can be caused to function as passive dampers in all travel sections. During travel in a non-curve section, the actuators Af2 and Ar2 can be caused to output the sway suppression force FS. During travel in a curve section, meanwhile, all of the actuators Af1, Af2, Ar1, Ar2 can be caused to function as passive dampers. By performing this control, a reduction in the passenger comfort of the railway vehicle can be suppressed.

When an abnormality occurs in the actuator Af2 that generates the sway suppression force FS during travel in a non-curve section, the actuator Af2 and the rear side actuator Ar2 that generates the sway suppression force FS can be caused to function as passive dampers in all travel sections. Meanwhile, the actuators Af1 and Ar1 can be caused to output the yaw suppression force Fω in all travel sections. By performing this control, a reduction in the passenger comfort of the railway vehicle can be suppressed.

When abnormalities occur simultaneously in one of the front side actuators Af1 and Af2 and one of the rear side actuators Ar1 and Ar2, the abnormal actuators can be caused to function as passive dampers, while the normal actuators are caused to output the yaw suppression force Fω or the sway suppression force FS in a non-curve section, and caused to output the yaw suppression force Fω in a curve section. In so doing, passenger comfort can be secured in curve sections while suppressing a reduction in the passenger comfort in other sections. Hence, according to the railway vehicle damping device 1, reductions in the passenger comfort of the railway vehicle can be kept at a minimum even when an abnormality occurs in an actuator or actuators.

In the railway vehicle damping device 1, front side vibration suppression force generating sources and rear side vibration suppression force generating sources are constituted by the actuators Af1, Af2, Ar1, Ar2 that are capable of functioning as passive dampers. Therefore, thrust regulation can be performed simply by regulating the relief pressure of the variable relief valve 22 without using a sensor. Further, the electric motor 15 is required to rotate only in a single direction, and therefore responsiveness to rotation direction switches need not be taken into account, meaning that an inexpensive electric motor can be used. This type of electric motor is easy to control and therefore favorable in terms of cost, and is also robust in terms of both hardware and software, and therefore optimum for the railway vehicle damping device 1. Furthermore, when an abnormality occurs, all of the actuators Af1, Af2, Ar1, Ar2 can still function as passive dampers, and therefore reductions in the passenger comfort of the vehicle body B can be minimized even when an abnormality occurs.

In the railway vehicle damping device 1 described above, the actuators Af1 and Af2 constitute the front side vibration suppression force generating sources while the actuators Ar1 and Ar2 constitute the rear side vibration suppression force generating sources. More specifically, the front side actuator Af1 corresponds to a part of the front side vibration suppression force generating sources, and the front side actuator Af2 corresponds to all of the remaining front side vibration suppression force generating sources. The rear side actuator Ar1 corresponds to a part of the rear side vibration suppression force generating sources, and the rear side actuator Ar2 corresponds to all of the remaining rear side vibration suppression force generating sources.

The contents of Tokugan 2012-56847, with a filing date of Mar. 14, 2012 in Japan, are hereby incorporated by reference.

Although the invention has been described above with reference to a certain embodiment, the invention is not limited to the embodiment described above. Modifications and variations of the embodiment described above will occur to those skilled in the art, within the scope of the claims.

For example, to obtain the effects of this invention more inexpensively, it is possible to provide only the actuators Af2 and Ar2, from among the actuators Af1, Af2, Ar1, Ar2, with both actuator and passive damper functions while providing the actuators Af1 and Ar1 with only an actuator function.

In the embodiment described above, four actuators per vehicle body B are applied to the railway vehicle damping device 1, but this invention applies to the case where two or more actuators are provided on each of the front and rear bogies. In other words, this invention may apply to any damping device in which respective parts of front and rear actuators are caused to generate the yaw suppression force Fω and remaining actuators are caused to function as passive dampers. The front side vibration suppression force generating sources and the rear side vibration suppression force generating sources may be constituted by adjustable damping force dampers, provided that at least a part thereof can function as passive dampers.

The railway vehicle damping device 1 described above is configured to perform H-infinity control, and therefore a superior damping effect can be obtained regardless of the frequency of the vibration input into the vehicle body B, with the result that a high degree of robustness is obtained. Nevertheless, control other than H-infinity control may be used as the damping control. For example, a yaw velocity and a sway velocity directly above the front bogie Tf and the rear bogie Tr of the vehicle body B may be calculated from the horizontal acceleration af and ar, whereupon the yaw suppression force Fω and the sway suppression force FS are calculated using skyhook control by multiplying a skyhook damping coefficient (a skyhook gain) by the yaw velocity and the sway velocity.

When variable damping force dampers are used as the front side vibration suppression force generating sources and the rear side vibration suppression force generating sources, Karnopp control may be used to realize a skyhook damper. The yaw suppression force Fω and the sway suppression force FS may be calculated from the yaw velocity and sway velocity directly above the front bogie Tf and rear bogie Tr of the vehicle body B, stroke directions of the variable damping force dampers, and the skyhook damping coefficient.

INDUSTRIAL APPLICABILITY

This invention brings about a favorable effect in improving passenger comfort in a railway vehicle.

The embodiment of this invention in which an exclusive property or privilege is claimed are defined as follows:

The invention claimed is:

1. A damping device for a railway vehicle, comprising:

at least two front side vibration suppression force generating sources interposed between a front bogie and a vehicle body of the railway vehicle;

at least two rear side vibration suppression force generating sources interposed between a rear bogie and the vehicle body of the railway vehicle; and a programmable controller programmed to:

determine a yaw suppression force for suppressing vibration in a yaw direction of the vehicle body;

cause the front side vibration suppression force generating sources and the rear side vibration suppression force generating sources to output the yaw suppression force;

cause, when the railway vehicle travels in a curve section, at least a part of the front side vibration suppression force generating sources and at least a part of the rear side vibration suppression force generating sources to output the yaw suppression force while causing all of remaining front side vibration suppression force generating sources and all of remaining rear side vibration suppression force generating sources to function as passive dampers; and cause, when the railway vehicle travels in a section other than the curve section, at least the part of the front side vibration suppression force generating sources and at least the part of the rear side vibration suppression force generating sources to output the yaw suppression force, and cause all of the remaining front side vibration suppression force generating sources and all of the remaining rear side vibration suppression force generating sources to output a sway suppression force for suppressing vibration in a sway direction of the vehicle body.

2. The damping device for the railway vehicle according to claim 1, wherein the front side vibration suppression force generating sources and the rear side vibration suppression force generating sources comprise electric actuators that function as passive dampers when a power current is not supplied.

3. The damping device for the railway vehicle according to claim 1, further comprising a locus information acquisition unit that obtains a locus information including a current travel locus of the railway vehicle, wherein the controller is further programmed to determine whether or not the railway vehicle is traveling in the curve section on the basis of the current travel locus of the railway vehicle.

4. The damping device for the railway vehicle according to claim 3, wherein the locus information acquisition unit comprises a monitor that obtains a travel locus information, and the controller is further programmed to determine whether or not the railway vehicle is traveling in the curve section on the basis of the travel locus information.

5. The damping device for the railway vehicle according to claim 1, wherein each of the front side vibration suppression force generating sources and the rear side vibration suppression force generating sources comprises:

a cylinder filled with a fluid;

a piston housed in the cylinder to be free to slide;

a rod inserted into the cylinder and coupled to the piston;

a rod side chamber and a piston side chamber defined within the cylinder by the piston;

a fluid tank;

a first opening/closing valve provided in a first passage connecting the rod side chamber and the piston side chamber;

a second opening/closing valve provided in a second passage connecting the piston side chamber to the tank;

a pump that supplies working oil from the tank to the rod side chamber;

a tank passage that connects the rod side chamber to the tank;

a variable relief valve provided in the tank passage, the variable relief valve having a variable relief pressure;

a suction passage that allows the fluid to flow only from the tank to the piston side chamber; and a one-way passage that allows the fluid to flow only from the piston side chamber to the rod side chamber.

6. The damping device for the railway vehicle according to claim 1, further comprising:

an acceleration sensor that detects a horizontal acceleration in a vehicle transverse direction of a vehicle front portion supported by the front bogie; and an acceleration sensor that detects a horizontal acceleration in a vehicle transverse direction of a vehicle rear portion supported by the rear bogie, wherein the controller is further programmed to calculate the yaw suppression force on the basis of the horizontal acceleration in the vehicle transverse direction of the vehicle front portion and the horizontal acceleration in the vehicle transverse direction of the vehicle rear portion.

7. The damping device for the railway vehicle according to claim 1, further comprising:

an acceleration sensor that detects a horizontal acceleration in a vehicle transverse direction of a vehicle front portion supported by the front bogie; and an acceleration sensor that detects a horizontal acceleration in a vehicle transverse direction of a vehicle rear portion supported by the rear bogie, wherein the controller is further programmed to calculate the sway suppression force on the basis of the horizontal acceleration in the vehicle transverse direction of the vehicle front portion and the horizontal acceleration in the vehicle transverse direction of the vehicle rear portion.

8. The damping device for the railway vehicle according to claim 1, wherein each of the front side vibration suppression force generating sources and the rear side vibration suppression force generating sources comprises:

a cylinder filled with a fluid;

a piston housed in the cylinder to be free to slide;

a rod inserted into the cylinder and coupled to the piston;

a rod side chamber and a piston side chamber defined within the cylinder by the piston;

a fluid tank storing fluid;

a first opening/closing valve provided in a first passage connecting the rod side chamber and the piston side chamber;

a second opening/closing valve provided in a second passage connecting the piston side chamber to the tank;

a pump that supplies the fluid from the tank to the rod side chamber;

a tank passage that connects the rod side chamber to the tank;

a variable relief valve provided in the tank passage, the variable relief valve having a variable relief pressure;

a suction passage that allows the fluid to flow only from the tank to the piston side chamber; and a one-way passage that allows the fluid to flow only from the piston side chamber to the rod side chamber.

9. A damping device for a railway vehicle, comprising:

a plurality of front side vibration suppression force generating sources interposed between a front bogie of the railway vehicle and a vehicle body of the railway vehicle;

a plurality of rear side vibration suppression force generating sources interposed between a rear bogie of the railway vehicle and the vehicle body; and a programmable controller programmed to:

determine a yaw suppression force for suppressing vibration in a yaw direction of the vehicle body;

cause the front side vibration suppression force generating sources and the rear side vibration suppression force generating sources to output the yaw suppression force;

cause, when the railway vehicle travels in a curve section, at least one of the front side vibration suppression force generating sources, but not all of the front side vibration suppression force generating sources, and at least one of the rear side vibration suppression force generating sources, but not all of the rear side vibration suppression force generating sources, to output the yaw suppression force while causing all of the remaining front side vibration suppression force generating sources and all of the remaining rear side vibration suppression force generating sources to function as passive dampers; and cause, when the railway vehicle travels in a section other than the curve section, the at least one of the front side vibration suppression force generating sources and the at least one of the rear side vibration suppression force generating sources to output the yaw suppression force, and cause all of the remaining front side vibration suppression force generating sources and all of the remaining rear side vibration suppression force generating sources to output a sway suppression force for suppressing vibration in a sway direction of the vehicle body.

* * * * *